US006402047B1

(12) United States Patent
Thomas

(10) Patent No.: US 6,402,047 B1
(45) Date of Patent: Jun. 11, 2002

(54) SNOW MAKING APPARATUS AND METHOD

(76) Inventor: Kevin S. Thomas, 829 Rte. 517, Glenwood, NJ (US) 07418

( * ) Notice: Subject to any disclaimer, the term of this patent is extended or adjusted under 35 U.S.C. 154(b) by 0 days.

(21) Appl. No.: 09/693,830

(22) Filed: Oct. 23, 2000

Related U.S. Application Data

(60) Provisional application No. 60/162,126, filed on Oct. 29, 1999.

(51) Int. Cl.[7] ..... F25C 3/04
(52) U.S. Cl. ..... 239/14.2; 239/2.2
(58) Field of Search ..... 239/2.2, 14.2

(56) References Cited

U.S. PATENT DOCUMENTS

| | | | |
|---|---|---|---|
| 3,010,660 A | 11/1961 | Barrett | |
| 3,298,612 A | 1/1967 | Torrens | |
| 3,408,005 A | 10/1968 | Struble et al. | |
| 3,716,190 A | 2/1973 | Lindlof | |
| 3,829,013 A | 8/1974 | Ratnik | |
| 3,831,844 A | 8/1974 | Tropeano et al. | |
| 3,969,908 A | 7/1976 | Lawless et al. | |
| 4,194,689 A | 3/1980 | Ash | |
| 4,275,833 A | 6/1981 | Fairbank | |
| 4,793,554 A | 12/1988 | Kraus et al. | |
| 4,993,635 A | 2/1991 | Dupre | |
| 5,890,654 A | 4/1999 | Dupre | |
| 6,039,265 A | * 3/2000 | Dupre et al. | 239/14.2 |
| 6,164,556 A | * 12/2000 | Dupre et al. | 239/14.2 |

FOREIGN PATENT DOCUMENTS

| | | |
|---|---|---|
| CA | 952153 | 7/1974 |
| CH | 411007 | 10/1966 |
| WO | WO 92/08936 | 5/1992 |

* cited by examiner

*Primary Examiner*—Lesley D. Morris
(74) *Attorney, Agent, or Firm*—Richard C. Litman

(57) ABSTRACT

The snow making apparatus includes an air tube and a water tube disposed in parallel relation and spaced apart by a predetermined distance. The air tube has a first end and a second end, the first end having an air inlet for receiving an air hose connected to an air compressor, the second end having a plug with a small diameter orifice defined therein for the egress of compressed air. The water tube has a first end and a second end, the first end having a water inlet for receiving a hose connected to a pressure washer which delivers water at 1200 p.s.i., and a second end coupled to a length of flexible copper tubing, the copper tubing being bent in order to discharge water into the stream of air discharged from the orifice at the second end of the air tube. The end of the copper tubing is compressed or crimped in order to discharge the water into the air stream in droplets or thin sheets. The water freezes upon exposure to cold, ambient air, the compressed air atomizing the water and prolonging the duration of the water droplets' exposure to the cold atmosphere, resulting in a blowing fog of snow.

9 Claims, 3 Drawing Sheets

SNOW MAKING APPARATUS AND METHOD

CROSS-REFERENCE TO RELATED APPLICATION

This application claims the benefit of U.S. Provisional Patent application Ser. No. 60/162,126, filed Oct. 29, 1999.

BACKGROUND OF THE INVENTION

1. Field of the Invention

The present invention relates to an apparatus and method for making snow, and particularly to an apparatus and method for producing snow suitable for household and farm use.

2. Description of the Related Art

Many popular winter sports and leisure time activities, such as sledding, snowboarding, skiing, etc., require that there be snow on the ground. While many areas of the country experience cold ambient air temperatures for extended time periods during the winter season, precipitation levels are variable and often below normal, so that there is insufficient snow on the ground. The dearth of snowfall may be disappointing not only for adults, but also for children and the parents of those children who would prefer that the youngsters had a viable choice of outdoor recreational activities during the cold weather.

One solution is to travel to winter resort areas, such as ski slopes, which may be located at higher elevations which receive a greater accumulation of snow, and which may make a substantial investment in commercial equipment for making snow artificially to supplement natural snowfalls. The problem with this approach is that such trips may require time off from work, and even weekend trips may be expensive after taking into consideration the cost of travel, lodging, food, admission fees, and various and sundry other expenses.

For many people a more practical solution may be a portable, inexpensive, easy to operate snow making apparatus which may be set up and operated in their own backyard, or on the sloping fields of a cooperative neighborhood farmer, when the temperature drops below freezing. The present invention addresses this need in the form of a device for making snow artificially which discharges water from a pressure washer into a stream of compressed air at subfreezing temperatures to produce artificial snow.

A number of devices for making snow are known in the art. Many such devices are geared to fill the need for large volumes of artificial snow for commercial applications, such as ski slopes. Such devices generally employ a mixing chamber in which air and water under pressure are mixed and then ejected into cold ambient air. Improvements in such devices have been described to alter the quality of the snow, to improve maintenance by preventing freezing of the mixture in the mixing chamber or at the discharge nozzle, and to increase the volume of snow produced or the ejection pattern.

Representative devices are described in U.S. Pat. No. 3,010,660, issued Nov. 28, 1961 to F. Barrett (large diameter, elongated tube widest at the middle and tapering at both ends); U.S. Pat. No. 3,298,612, issued Jan. 17, 1967 to R. L. Torrens (water inlet and compressed air inlet joined at acute angle at the entrance of the mixing chamber and a plurality of baffles disposed in the mixing chamber); U.S. Pat. No. 3,408,005, issued Oct. 29, 1968 to Struble, et al. (water jacket disposed about the mixing chamber and a helical spring disposed in the mixing chamber to impart corkscrew mixing); U.S. Pat. No. 3,716,190, issued Feb. 13, 1973 to J. A. Lindlof (water conduit having a venturi tube with compressed air introduced at 90° angle into the throat of the venturi, and vanes in the discharge nozzle to cause turbulence); and U.S. Pat. No. 3,829,013, issued Aug. 13, 1974 to H. R. Ratnik (a blocking member in the mixing chamber with sloping walls and an anvil with a concave surface supported by ribs).

Additional examples are shown in U.S. Pat. No. 3,831,844 (apparatus with a pair of spaced apart discharge nozzles); U.S. Pat. No. 3,969,908, issued Jul. 20, 1976 to Lawless, et al. (an apparatus which includes cold air produced by a Vortex tube for producing snow regardless of the ambient temperature); U.S. Pat. No. 4,194,689, issued Mar. 25, 1980 to R. M. Ash (concentric tubes with aligned orifices, the inner tube having compressed air which forces water in the outer tube through the orifices in the outer tube); U.S. Pat. No. 4,275,833, issued Jun. 30, 1981 to B. H. Fairbank (similar to the Ash patent, but with curvilinear tubes); and U.S. Pat. No. 4,793,554, issued Dec. 27, 1988 to Kraus, et al. (a water tube inside an air jacket, the air entering the water tube through orifices at a 15° angle, the stream diverging, passing through an orifice plate, a converging tube, and out a nozzle).

Still other examples are shown in U.S. Pat. Nos. 4,993,635 and 5,890,654, issued Feb. 19, 1991 and Apr. 6, 1999, respectively, to H. K. Dupre (snow making tower with a plurality of water discharge nozzles angles outward angularly and a plurality of air discharge nozzles directed normal to the tube and into the discharged stream of water); Swiss Patent No. 411,007, published Oct. 31, 1966 (device with a pair of homogenation chambers and a pair of discharge nozzles); Canadian Patent No. 952,153, issued Jul. 30, 1974 (device with compressed air flowing through a disc with slanted slots in the mixing chamber for imparting a spiral motion to the mixture); and International Patent No. WO 92/08936, published May 29, 1992 (snow cannon with water and air mixture chilled by liquid nitrogen at the discharge nozzle).

None of the above inventions and patents, taken either singly or in combination, is seen to describe the instant invention as claimed.

SUMMARY OF THE INVENTION

The snow making apparatus includes an air tube and a water tube disposed in parallel relation and spaced apart by a predetermined distance. The air tube has a first end and a second end, the first end having an air inlet for receiving an air hose connected to an air compressor, the second end having a plug with a small diameter orifice defined therein for the egress of compressed air. The water tube has a first end and a second end, the first end having a water inlet for receiving a hose connected to a pressure washer which delivers water at 1200 p.s.i., and a second end coupled to a length of flexible copper tubing, the copper tubing being bent in order to discharge water into the stream of air discharged from the orifice at the second end of the air tube. The end of the copper tubing is compressed or crimped in order to discharge the water into the air stream in droplets or thin sheets. The water freezes upon exposure to cold, ambient air, the compressed air atomizing the water and prolonging the duration of the water droplets' exposure to the cold atmosphere, resulting in a blowing fog of snow.

Accordingly, it is a principal object of the invention to provide a snow making apparatus for producing snow artificially in cold ambient air.

It is another object of the invention to provide a snow making apparatus for producing sufficient snow in a residential back yard for sledding, snowboarding, practice skiing, and other winter sports and leisure activities.

It is a further object of the invention to provide a device for producing snow in cold weather which is compact, simple in construction, and easy for the average homeowner to deploy and operate.

Still another object of the invention is to provide a snow making apparatus and a method for making snow which combines water supplied under pressure from a pressure washer and compressed air to produce snow in a subfreezing ambient atmosphere.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
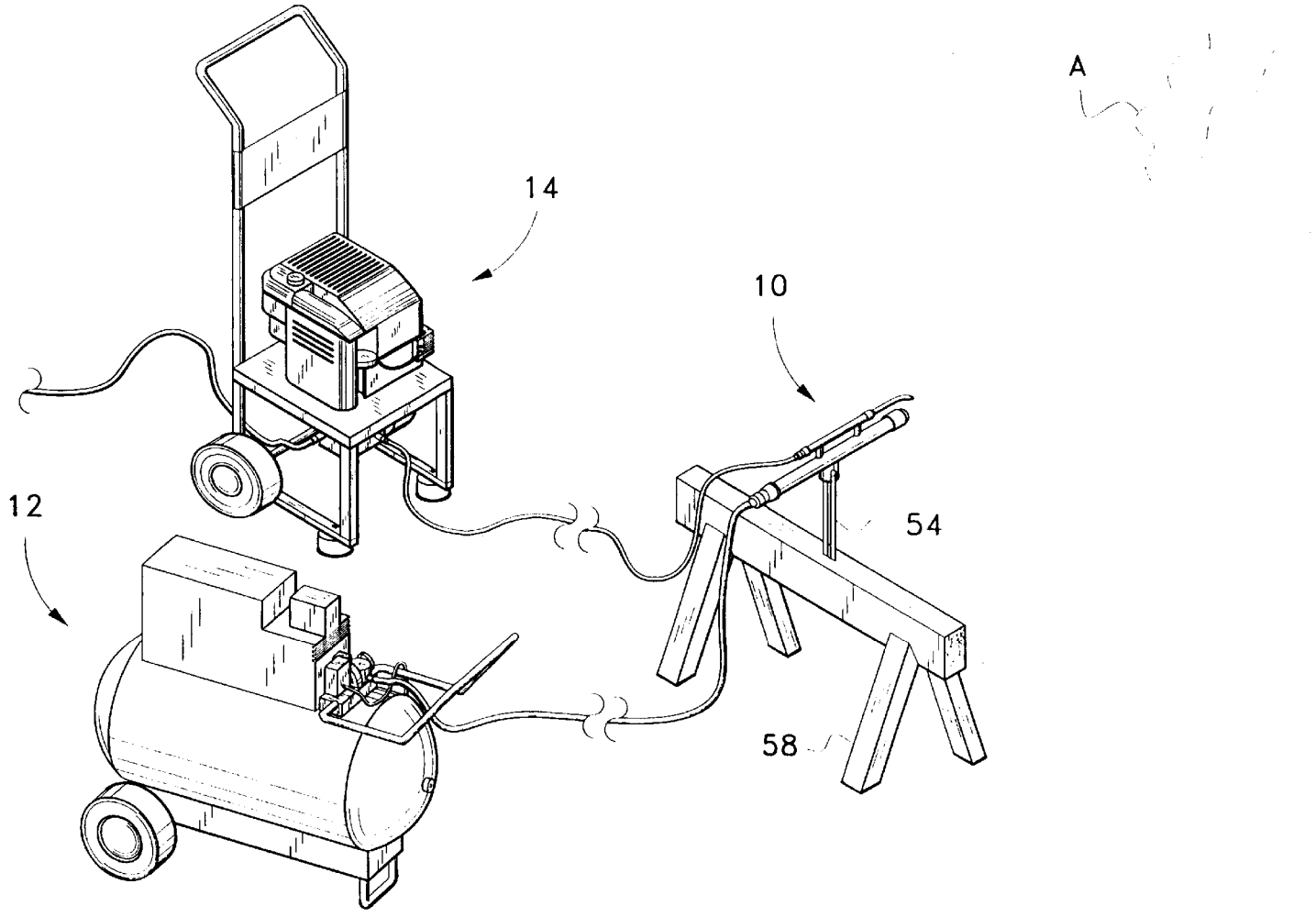
FIG. 1 is an environmental, perspective view of a snow making apparatus according to the present invention.

The present invention is a snow making apparatus, designated generally as 10 in the drawings, and a method for making snow. The apparatus 10 is a portable, economical, easy to use device intended for providing residential homeowners with a device for producing sufficient snow for sledding, snowboarding, and other winter activities as an affordable alternative to the necessity of booking time at a winter resort in order to enjoy leisure activities which require snow.

As shown in FIG. 1, the apparatus 10 uses a source of compressed air, such as an air compressor 12, and water under pressure proceed by a pressure washer 14, to produce a fog of snow A when the ambient air temperature is not greater than about 28° F. The air compressor 12 may be a conventional air compressor capable of producing air at about 100 p.s.i. The pressure washer 14 is also a conventional unit of the type used for cleaning cars, boats, engine blocks, aluminum siding, etc. The pressure washer 14 should be capable of discharging water at about 1200 p.s.i. Both the air compressor 12 and the pressure washer 14 are commercially available and will not be described further.

Figure 2:
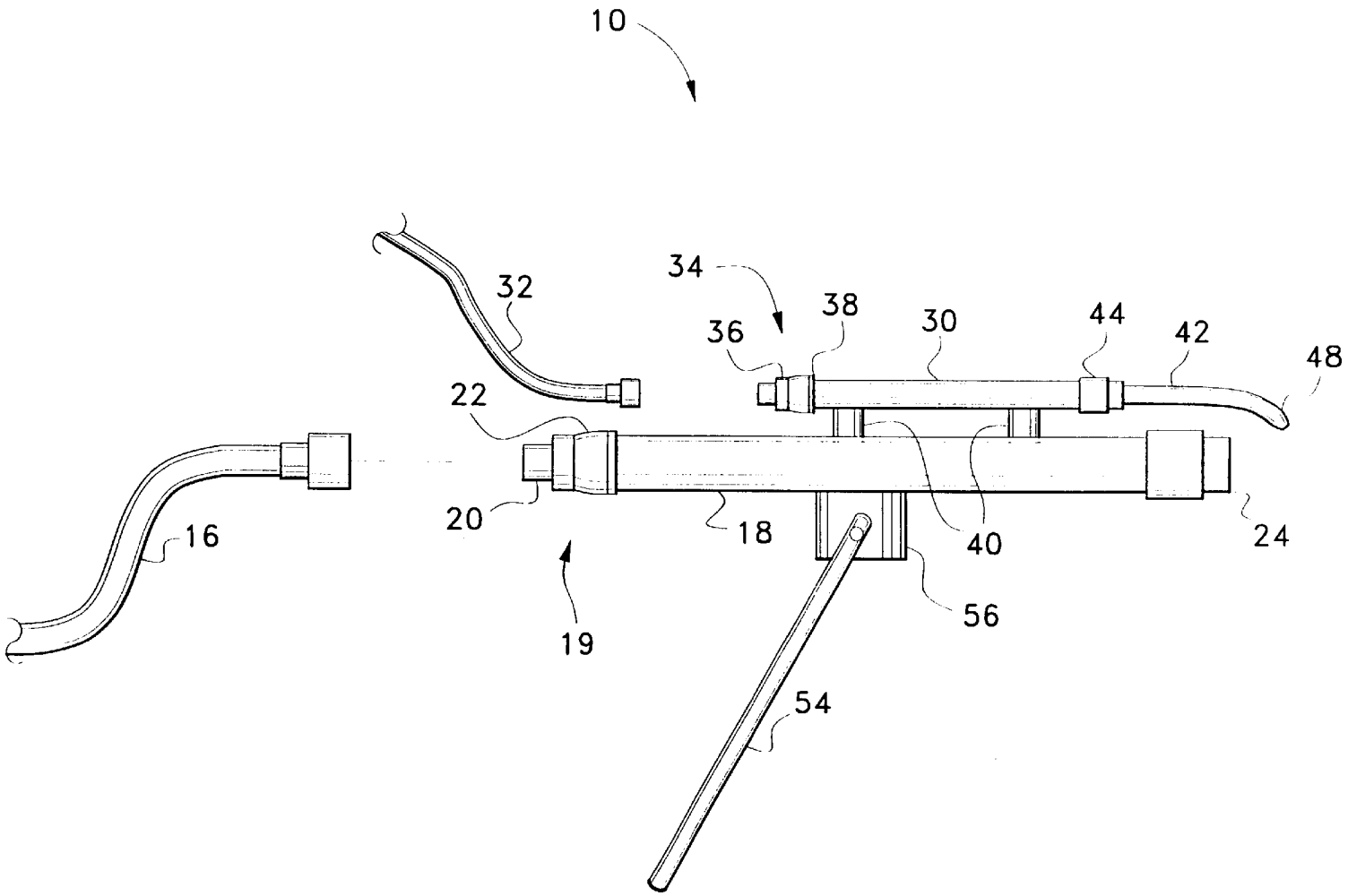
FIG. 2 is a front elevational view of a snow making apparatus according to the present invention.
Figure 3:
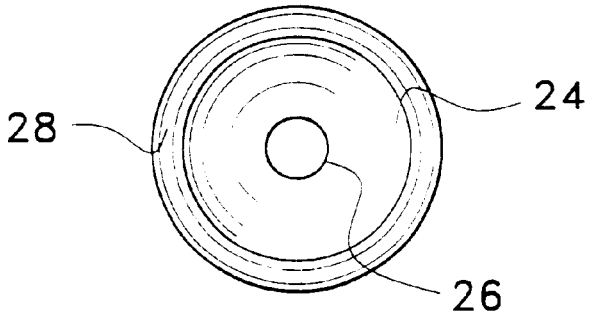
FIG. 3 is an end view of the air tube of the snow making apparatus according to the present invention.

Referring to FIG. 2, air under pressure is delivered from the air compressor 12 by a standard ⅜" air hose 16 to an air tube 18. The air tube 18 is a rigid, hollow length of ½" pipe. The air; tube 18 is adapted for connection to the air hose 16 by an air inlet 19, e.g., by a ¼ turn ball valve 20 connected to the pipe by an appropriate reducer coupling 22. The opposite end of the air tube 18 is equipped with a ½" brass plug 24 having an orifice 26 (seen in FIG. 3) defined therein through the center of the plug 24. The plug 24 may be attached to the tube 18 by an appropriate coupler 28. The orifice 26 has a narrow diameter, preferably about 0.125".

Figure 4:
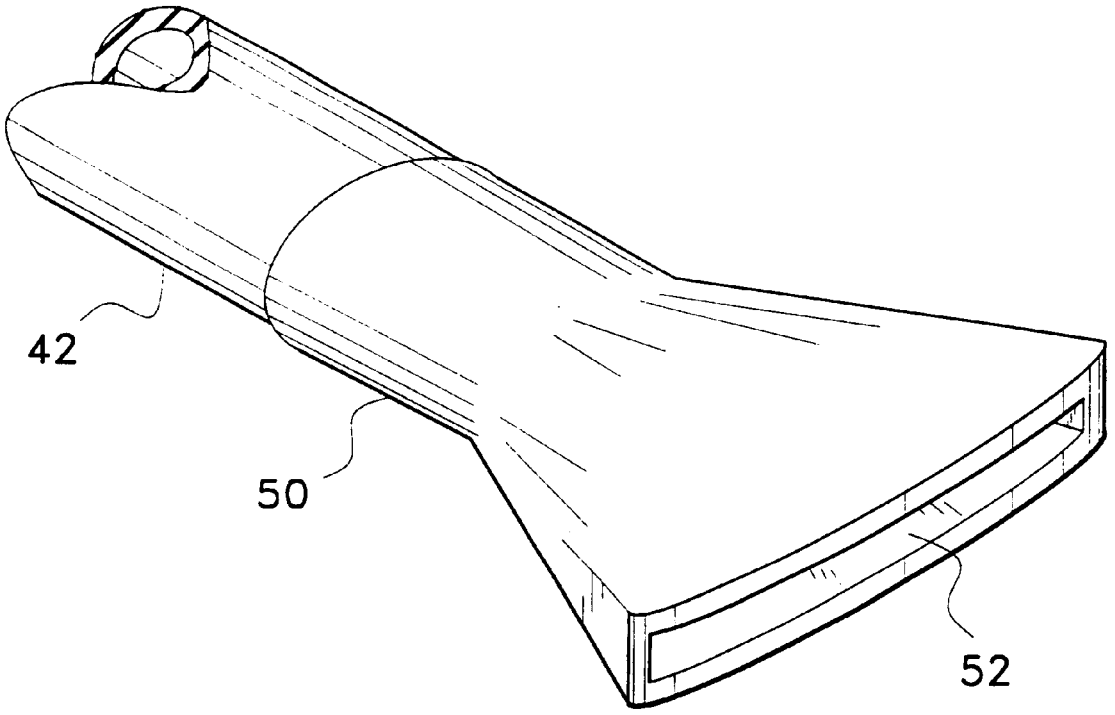
FIG. 4 is a fragmented, perspective view of an alternative embodiment of a nozzle for the water tube of the snow making apparatus according to the present invention.

Water under pressure is delivered from the pressure washer 14 to a water tube 30 by a standard 1/41" high pressure water hose 32. The water tube 30 is a rigid, hollow length of ¼" pipe. The water tube 30 is mounted to the air tube 18 by a pair of spacers 40, which maintain the water tube 30 in parallel, fixed relation to the air tube 18 by a predetermined distance. It has been found that mounting the air tube 18 and the water tube 30 in spaced apart relation and mixing the water and air externally to the tubes, rather than disposing the tubes concentrically with an internal mixing chamber, results in easier maintenance and prevents the discharge orifices or nozzle from becoming clogged with ice or snow. The water tube 30 is adapted for connection to the water hose 32 by a water inlet 34, e.g., by a ¼ turn ball valve 36 connected to the pipe by an appropriate coupler 38. A pliable length of hollow copper tubing 42 having a smaller diameter, e.g., 0.158" outside diameter, is attached to the opposite end of the water tube 30 by an appropriate coupler 44, the water tube 30 and the copper tubing 42 forming a continuous conduit for the passage of water. The end of the tubing 42 is crimped or flattened in order to define a nozzle 48 for dispersing the stream of water into droplets, or at least a thin sheet. Alternatively, a wing tipped nozzle 50 (shown in FIG. 4) which disperses the stream of water through its tapered, flaring walls and narrow slit discharge orifice 52 may be fixedly attached to the end of the tubing 42. The copper tubing 42 is bent in order to dispose the discharge orifice 52 into, or slightly above the stream of air exiting the orifice 26 defined in the plug 24 defined in the air tube 18.

The air tube 18 may have one or more support legs 54 attached thereto by a mounting plate 56, so that the tubes 18 and 30 may be mounted on, or fastened to, an appropriate base 58. Preferably the support legs 54 are mounted at an angle so that the water and air are discharged at an elevation angle relative to horizontal, so that the compressed air causes the water to be dispersed and propelled at high velocity for a greater time flight through the cold air than expelling the water and air parallel to the ground, and resulting in a cloudy, swirling fog of snow for more even distribution of snow over a large area. The lengths of the water tube 30 and the air tube 18 are not critical. The overall length of the air tube 18 may be, e.g., about fourteen inches, and the water tube 30 may be somewhat less than half that length. The water tube may be made from a thermoplastic material, such as polyvinyl chloride (PVC), in order to for low cost and easy maintenance, since PVC does not rust. However, it is preferred that both the air tube 18 and the water tube 30 be made from a lightweight, thermally conductive metal, such as aluminum, copper, or stainless steel to pre-cool the water and air supplied to the, apparatus 10.

In use, the apparatus 10 is deployed in the area to be covered with snow when the ambient temperature is not greater than about 28° F. Air is supplied to the air tube 18 at a pressure of about 100 p.s.i. Water is supplied to the water tube 30 at a pressure of about 1200 p.s.i. The water undergoes turbulence as it is forced against the tapered walls of the nozzle 48 or 50 and is ejected under pressure in dispersed droplets into the stream of compressed air exiting the orifice of the air tube 18, being projected at a parabolic arc and forming a high velocity of fog, from which the moisture condenses and crystallizes as snow flakes. The azimuth may be changed to coat an entire lawn with snow to the desired depth.

The method of making snow according to the present invention may be stated as comprising the following steps:

(1) connecting an air compressor to an air inlet of an air tube having a small diameter discharge orifice; (2) connecting a pressure washer to a water tube having a crimped nozzle, the water tube being in parallel spaced relation to the air tube and the crimped nozzle being disposed to discharge water into an air stream exiting the discharge orifice of the air tube; (3) disposing the air tube and water tube in an ambient atmosphere of about 28° F. with the discharge orifice of the air tube at an elevation angle relative to horizontal; (4) supplying air at a pressure of about 100 p.s.i. to the air tube; and (5) supplying water at a pressure of about 1200 p.s.i. to the water tube in order to produce a fog of snow propelled by air exiting the discharge orifice of the air tube.

It is to be understood that the present invention is not limited to the sole embodiments described above, but encompasses any and all embodiments within the scope of the following claims. In particular, it will be understood that the dimensions cited above are exemplary dimensions provided for enablement purposes, and not by way of limitation.

I claim:

1. A snow making apparatus for making snow in an ambient air temperature below about 28° F., comprising:

a) a rigid, hollow air tube having a first end and a second end;

b) an air inlet having a connector adapted for attachment to a supply of compressed air disposed at the first end of said air tube;

c) an air outlet disposed at the second end of said air tube for the outlet of a stream of compressed air;

d) a rigid water tube disposed in parallel relation to, and spaced apart a predetermined distance from, said air tube, the water tube having a first end and a second end;

e) a water inlet having a connector adapted for attachment to a supply of water under pressure disposed at the first end of said water tube; and f) a pliable conduit disposed at the second end of said water tube, said conduit having a nozzle disposed at an end thereof, said conduit and said water tube defining a continuous passage for the flow of water, said conduit being bent in order to dispose the nozzle in the outlet path of said air tube, said nozzle being flattened and having a narrow slit for the discharge of water from said air tube.

2. The snow making apparatus according to claim 1, wherein said air inlet comprises a one quarter turn ball valve.

3. The snow making apparatus according to claim 1, wherein said water inlet comprises a one quarter turn ball valve.

4. The snow making apparatus according to claim 1, wherein said conduit comprises a length of pliable copper tubing, said nozzle being defined by a crimped end of said tubing.

5. The snow making apparatus according to claim 1, wherein said nozzle comprises a wing tip nozzle attached to the end of said conduit.

6. The snow making apparatus according to claim 1, wherein said air tube and said water tube are made from a thermally conductive metal.

7. The snow making apparatus according to claim 1, further comprising a pressure washer attached to said water inlet.

8. The snow making apparatus according to claim 7, wherein said pressure washer is capable of discharging water having a pressure of about 1200 p.s.i.

9. A method for making snow in an ambient air temperature below about 28° F., comprising the steps of:

(a) connecting an air compressor to an air inlet of an air tube having a small diameter discharge orifice;

(b) connecting a pressure washer to a water tube having a crimped nozzle, the water tube being in parallel spaced relation to the air tube and the crimped nozzle being disposed to discharge water into an air stream exiting the discharge orifice of the air tube;

(c) disposing the air tube and water tube in an ambient atmosphere of about 28° F. with the discharge orifice of the air tube at an elevation angle relative to horizontal;

(d) supplying air at a pressure of about 100 p.s.i. to the air tube; and (e) supplying water at a pressure of about 1200 p.s.i. to the water tube in order to produce a fog of snow propelled by air exiting the discharge orifice of the air tube.

* * * * *